US006339055B1

(12) United States Patent
Brooker et al.

(10) Patent No.: US 6,339,055 B1
(45) Date of Patent: Jan. 15, 2002

(54) CLEANING COMPOSITIONS

(75) Inventors: Alan Thomas Brooker, Newcastle upon Tyne; Stephen Wayne Heinzman, Whitley Bay; Francisco Ramon Figueroa, Tyne & Wear, all of (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/508,438

(22) PCT Filed: Sep. 17, 1998

(86) PCT No.: PCT/IB98/01440

§ 371 Date: Mar. 9, 2000

§ 102(e) Date: Mar. 9, 2000

(87) PCT Pub. No.: WO99/14303

PCT Pub. Date: Mar. 25, 1999

(30) Foreign Application Priority Data

Sep. 18, 1997 (GB) ..... 9719779

(51) Int. Cl.[7] ..... C11D 3/00; C11D 7/18; C11D 7/54

(52) U.S. Cl. ..... 510/301; 510/302

(58) Field of Search ..... 510/301, 302, 510/303

(56) References Cited

U.S. PATENT DOCUMENTS 3,666,680 A * 5/1972 Briggs ..... 252/316
4,961,755 A * 10/1990 Bruttel et al. ..... 8/526
5,670,468 A * 9/1997 Moens ..... 510/226
5,759,981 A * 6/1998 Boutique et al. ..... 510/304

FOREIGN PATENT DOCUMENTS

EP 0 003 861 * 9/1979
WO WO 97/43393 * 11/1997

* cited by examiner

*Primary Examiner*—Yogendra N. Gupta
*Assistant Examiner*—John M. Petruncio
(74) *Attorney, Agent, or Firm*—Richard S. Echler, Sr.; Kim W. Zerby; Steven W. Miller

(57) ABSTRACT

The present invention relates to a photo bleaching compositions comprising:

A) from 0.5 ppm by weight, of a photo bleaching agent, said agent comprising:

a) a polymeric component, said polymeric component comprising one or more polymeric compounds having an average molecular weight of from 500 to 1,000,000 wherein at least 50% of the monomers which comprise said polymeric compounds comprise one or more di-polar, aprotic groups and have a polymerizable vinyl moiety, the balance comprising monomers selected from the group consisting of acrylic acid, acrylic acid esters, acrylic acid amides, methacrylic acid, methacrylic acid esters, methacrylic acid amides, and mixtures thereof; and b) a photo bleaching component, said photobleaching component comprising a porphyrin or a phthalocyanine ring wherein said phthalocyanine ring can optionally be substituted at one or more ring positions, and said ring comprising a transition metal or cation having an oxidation state of two or greater;

wherein said photo bleaching component is integrated with said polymeric component to form said photo bleaching agent and the weight ratio of polymeric component (a) to photobleaching component (b) is from 1:1 to 1000:1;

B) from 0.1% by weight, of a peroxy acid bleaching compound precursor; and

C) the balance carriers and adjunct ingredients.

19 Claims, No Drawings

CLEANING COMPOSITIONS

TECHNICAL FIELD

The invention relates to bleaching compositions and cleaning compositions comprising the bleaching compositions, containing a specific photo-bleaching agent and a bleaching agent capable of providing a peroxyacid bleaching compound. The compositions are particularly useful in laundry and dish washing processes to provide enhanced photo-bleaching performance, fabric whiteness appearance and overall cleaning.

BACKGROUND OF THE INVENTION

Various compounds are known in the art which, upon exposure to light, can be photo-activated, to become an active species for chemical or further photo-chemical reactions.

Two general examples thereof are porphyrin and phthalocyanine photo-bleaching compounds. These compounds, unmetallated and especially when combined with a suitable cation, can undergo a series of reactions, starting with a photochemical reaction step which transforms the compound into an excited state. The excited state of the molecule can react with stains to bleach them or alternatively after subsequent reaction steps in conjunction with molecular oxygen can produce "active oxygen". Active oxygen includes molecules of "singlet oxygen" or superoxide. Superoxide can subsequently be converted to hydrogen peroxide. "Singlet oxygen", superoxide or hydrogen peroxide, formed in this series of reactions, are oxidative species capable of reacting with stains to chemically bleach them to a colourless and usually water-soluble state, thereby resulting in what is called photochemical bleaching. Examples of porphyrins or porphyrin-like compounds include haematoporphyrin, chlorophyll, chlorine, oxochlorins, pheophorbide, pyropheophorbide, benzoporphyrins, tetra-arylporphyrin, zinc tetraphenylporphyrin, tripyrroledimethane-derived expanded porphyrins. Examples of phthalocyanines and naphthalocyanines include zinc, aluminum, indium, silicon, and gallium phthalocyanines and naphthalocyanines, the most common being the zinc and aluminium phthalocyanines.

Other examples of photobleaches are xanthene dyes such as rose bengal, eosin, and fluorescein. Additional photobleach examples include metachromic dyes such as thionine, methylene blue, benzo[a]phenoxazinium (Nile Blue A), and benzo[a]phenothiazinium. A limitation to the use of some of these more water-soluble photo-bleaches can be their poor surface-activity.

One problem associated with the use of phthalocyanine, naphthalocyanines, and porphyrin photo-bleaching compounds arises from the fact that these are not water soluble, in particular when the parent rings are substituted solely with hydrogen.

It has been a task for the formulators of photo-bleaching compounds and cleaning products to prepare photo-bleaching agents which are soluble in water. In an effort to do so, various patent documents relate to photo-bleaching with phthalocyanine derivatives, having various solubilising substituents, such as EP-119746, EP-379312, EP-553608, EP-596187 and EP-692947. These documents teach selected substituent units that are hydrophilic and which are bonded to the photo-sensitive ring units to enhance the solubility or photochemical properties of the molecule. In general, three or more substituents are needed to obtain the required solubility.

However, a problem relating to the introduction of (high numbers of) substituent groups to the photo-bleaching compound (to ensure a certain level of water solubility) is that the photo-bleaching properties of the ring system are often affected. For example, a change which increases solubility may reduce the quantum efficiency of the molecule. This can render the derivative compound without sufficient photo-bleaching properties. Firstly, this can lead to less formation of singlet oxygen and thus less bleaching. Secondly, the absorption spectrum may change, leading to an undesirable colouring of the photo-bleaching compounds in use, which is in particular a problem when used for photo-bleaching of fabrics.

It is known in the art how to prepare these derivative photo-bleaching agents. However, the preparation of these derivative photo-bleaching agents can proceed in low yield which introduces impurities and increases cost. These impurities may also introduce undesirable colouring which produces staining, in particular when used on fabric.

Another major limitation to the use of most photo-bleaching compounds known in the art is that they are highly coloured materials (having an absorption in the range of 600–800 nanometres). For example, high concentrations of these compounds on the fabric will thus lead to staining of the fabric. Therefore, deposition of the photo-bleaching compounds in high quantities on the fabric in the wash should be avoided. Furthermore, build up of these compounds on fabric surface should be avoided.

Yet another limitation of most photo-bleaching compounds known in the art is that introduction of solubilising groups tends to destabilise the compounds so that they tend to decompose once exposed to light, in particular sunlight, which deactivates them as photo-bleaching compound, thus leading to a lesser bleaching performance. Furthermore, in cleaning compositions containing the photo-bleaching compounds it is often required that additional bleaching agents are present. However, these bleaching agents can also cause decomposition and inactivation of the photo-bleaching agents.

Thus, there is a need for improved photo-bleaching compounds which are water-soluble, which have optimum photo-bleaching properties, and will overcome the decomposition and build up problems.

The inventors now have found improved photo-bleaching agents for use in cleaning compositions. The photo-bleaching agent is formed by integrating a photo-bleaching compound (which is insoluble in water or slightly water-soluble) with a specific, water-soluble polymeric compound. The inventors have found that thus a photo-bleaching agent is obtained which is has an improved solubility in water and which has an improved surface-activity. While not being bound by theory, the improvement in photobleaching results from photo-bleaching agents which have an improved affinity for the soils present on fabric for laundering. Thus, more specific and effective bleaching of these soils is achieved. In addition, the photo-bleaching agents included in the invention may provide more efficient photo-bleaching performance because they are more stable when exposed to light or bleach. Thus for a given amount of photobleaching agent deposited on a surface, a higher amount of singlet oxygen or other bleaching species can be generated before the photobleaching agent decomposes. Also, the photo-bleaching agent has an absorption spectrum which results in a desired colour, in particular blue, of the agent and of the fabric comprising the agent. Furthermore, they have found that the photo-bleaching agent migrates evenly to the fabric surface.

Thus localised high quantities of photo-bleaching agent, leading to staining, can be avoided. They also have found that the agent accumulates to a lesser extent on the fabric in subsequent washings. Also staining of the fabric by highly coloured, inactive agents can be avoided because the photo-bleaching agent of the invention can be prepared without introduction of impurities. Additionally, the photo-bleaching agent can provide a desired hueing on the fabric, leading to an improved fabric appearance.

The inventors have now found that detergents comprising these novel photo-bleaching agents and a bleaching agent capable of providing a peroxyacid bleaching species, have a surprisingly improved bleaching performance. It has been found that the efficiency of the peroxyacid-containing or peroxyacid-providing bleaching agent is improved when the novel photo-bleaching agents are present. It is believed to be caused by the generation by the photo-bleaching agent of peroxyacid radicals rather than singlet oxygen under influence of sunlight. The peroxyacid radicals are believed to provide an improved bleaching performance.

The improved performance and efficiency results in improved cleaning of bleachable stains and an improved whiteness appearance of the fabrics and or alternatively, it allows the formulation of cleaning compositions with a reduced level of bleaching agent or photo-bleaching agent.

SUMMARY OF THE INVENTION

The present invention provides a bleaching composition comprising:

(a) of from 0.5 ppm by weight of a photo-bleaching agent, comprising a polymeric component and a photo-bleaching component, integrated with one another;

(b) of from 0.1% by weight of a bleaching agent capable of providing an peroxyacid compound.

The bleaching composition is preferably present in a cleaning composition, preferably a dish washing detergent or even more preferably a laundry detergent.

DETAILED DESCRIPTION OF THE INVENTION

Photo-Bleaching Agent

The photo-bleaching agent of the invention comprises one or more specific polymeric components and one or more photo-bleaching components integrated with one another, as described herein.

'Integrated with one another' when used herein refers to the integration between the components of the agent, which is obtainable by a process comprising the steps of a) forming a melt of or a solution, comprising a photo-bleaching compound and a polymeric compound;

b) in a further step, forming and separating the photo-bleaching agent.

This may mean that the photo-bleaching component is adsorbed onto or absorbed in the polymeric component, or that the polymeric component and the photo-bleaching component form an associative complex-structure or coacervate complex-structure.

The weight ratio of the polymeric component to the photo-bleaching component in the photo-bleaching agent is from 1:1 to 1000:1, more preferably from 5:1 to 1000:1, more preferably 20:1 to 100:1, most preferably from 20:1 to 60:1.

The photo-bleaching agent of the invention preferably comprises from 50% to 99.9% by weight, more preferably from 90% to 99.9% by weight, more preferably from 92% to 99% by weight, most preferably from 95% to 98% by weight the polymeric component.

The photo-bleaching agent of the invention preferably comprises from 0.1% to 50% by weight, more preferably from 0.1% to 10% by weight, more preferably from 1% to 8% by weight most preferably from 2% to 5% by weight the photo-bleaching component. When the agent is used on fabrics, the higher levels of the photo-bleaching component can be preferred when a hueing effect on the fabrics is desirable.

It may be preferred that the photo-bleaching agent is coated or encapsulated. Preferred coating or encapsulating agents are for example starch, sucrose, glycerine, waxes and oils, or preferably mixtures thereof. Usually, the coating or encapsulating material is present at a weight ratio to the photo-bleaching agent of from 2:1 to 15:1, preferably about 8:1 to 12:1.

The bleaching composition herein comprises the photo-bleaching agent at a level of at least 0.5 ppm by weight. Typically, the photo-bleaching agent is incorporated in a bleaching composition, or the cleaning compositions comprising the bleaching composition, at a level of from 0.75 ppm to 3% by weight, more preferably from 1.0 ppm to 1% by weight, even more preferably from 5.0 ppm to 0.5% by weight and highly preferred around 15 ppm to 300 ppm or even to 150 ppm.

In solid cleaning compositions herein, it may be preferred that the photo-bleaching agent is present as a separate particle, preferably as a dry-added or dry mixed particle. It may be preferred that the photo-bleaching agent is premixed with the anionic surfactants herein or with other, additional ingredients of the compositions, as described hereinafter. The photo-bleaching agent may also be sprayed onto the particle comprised in the solid cleaning compositions herein.

Polymeric Compounds

The polymeric compound for integration with a photo-bleaching compound to form the polymeric component of the photo-bleaching agent of the invention, preferably comprises polymerised monomeric units which comprise di-polar, aprotic groups.

Preferably, at least 50%, more preferably at least 75%, more preferably at least 90%, even more preferably at least 95% of the polymerised monomeric units comprise a di-polar, aprotic group.

The polymeric compounds of the invention can be homo-polymers, comprising a backbone having one type of polymerised monomeric units, or co-polymers comprising a backbone having different polymerised monomeric units.

The polymeric compounds preferably have a number average molecular weight of from 500 to 1,000,000, more preferably from 1.000 to 100,000, more preferably from 2000 to 80,000, most preferably from 5000 to 60,000.

Highly preferred monomeric units include vinylamides such as N-vinylpyrrolidone and N-vinylacetamide as well as vinylheterocycles such as N-vinylimidazole, N-vinyloxazolidone, N-vinyltriazole, 4-vinylpyridine, and 4-vinylpyridine-N-oxide. These dipolar, aprotic group-containing, monomeric units are particularly effective for solubilising the photo-bleaching component.

Co-monomers can be used to confer additional properties to the polymer such as charge, hydrophilicity and hydrophobicity. Suitable comonomers include acrylic acid or methacrylic acid, their salts, and their esters including methyl, ethyl, hydroxyethyl, propyl, hydroxypropyl, butyl, ethylhexyl, decyl, lauryl, i-bomyl, cetyl, palmityl, phenoxyethyl, stearylacrylate. Also included are diethylaminoethylacrylate, dimethylaminoethylacrylate, dimethylaminopropylacrylate, and choline esters of acrylic or methacrylic acid. Also included are acrylamide or methacrylamide and their various N-substituted derivatives including N-methylol-acrylamide, N,N-dimethylaminopropylacrylamide, N,N,N-trimethylammoniumpropylacrylamide, N,N-diethylaminopropylacrylamide, N-tert-butylacrylamide, N-tert-octylacrylamide, N-undecylacrylamide, 2-acrylamido-2-methylpropanesulfonic acid. Also included are vinyl esters such as vinyl acetate, vinyl propionate, vinyllaurate, neooctanoic acid vinylester, neononanoic acid vinylester, neodecanoic acid vinylester. Also included are other vinyl monomers such as styrene, vinyltoluene, α-methylstyrene. Also included are unsaturated acids such as crotonic acid, maleic acid, fumaric acid, itaconic acid or their respective anhydride or esters.

Most preferred polymeric compounds in accordance with this invention are polyvinylimidazole (PVI), or a copolymer of polyvinylpyrrolidinone and polyvinylimidazole (PVPVI), most preferably polyvinylpyrrolidinone (PVP).

Preferably, these highly preferred polymeric compounds have an average molecular weight of from 20,000 to 60,000.

Also, mixtures of two or more polymeric compounds, described herein can be used for integration with a photo-bleaching compound to form the polymeric component of the photo-bleaching agent of the invention.

Photo-Bleaching Compound

The photo-bleaching compound for integration with a polymeric compound to form the photo-bleaching component of the photo-bleaching agent of the invention can be any compound known in the art which can undergo a reaction or a series of reactions, starting with a photochemical reaction in conjunction with molecular oxygen to produce molecules of "active oxygen". Active oxygen includes molecules of "singlet oxygen" or superoxide. Superoxide can subsequently be converted to hydrogen peroxide. "Singlet oxygen", superoxide or hydrogen peroxide, formed in this series of reactions, are oxidative species capable of reacting with stains to chemically bleach them to a colourless and usually water-soluble state, thereby resulting in what is called photochemical bleaching Preferred photo-bleaching compounds are compounds having a porphin or porphyrin structure.

Porphin and porphyrin, in the literature, are used as synonyms, but conventionally porphin stands for the simplest porphyrin without any substituents; wherein porphyrin is a sub-class of porphin. The references to porphin in this application will include porphyrin.

The porphin structures preferably comprise a metal element or cation, preferably Ca, Mg, P, Ti, Cr, Zr, In, Sn or Ff, more preferably Ge, Si or Ga, or more preferably Al, most preferably Zn.

It can be preferred that the photo-bleaching compound or component is substituted with substituents selected from alkyl groups such as methyl, ethyl, propyl, t-butyl group and aromatic ring systems such as pyridyl, pyridyl-N-oxide, phenyl, naphthyl and anthracyl moieties.

The photo-bleaching compound or component can have solubilising groups as substituents, however, for the present invention it is preferred that the photo-bleaching compound or component has only 2 or less solubilising substituent groups. Even more preferably the photo-bleaching compound or component has no solubilising substituent groups, or most preferably is unsubstituted.

Highly preferred photo-bleaching compounds are compounds having a phthalocyanine structure, which preferably have the metal elements or cations described above.

Metal phthalocyanines and their derivatives have the structure indicated in FIG. 1 and/or FIG. 2, wherein the atom positions of the phthalocyanine structure are numbered conventionally.

The phthalocyanines can be substituted for example the phthalocyanine structures which are substituted at one or more of the 1–4, 6, 8–11, 13, 15–18, 20, 22–25, 27 atom positions of FIG. 1 and/or FIG. 2.

A highly preferred transition metal phthalocyanine however is non-substituted phthalocyanine.

for oxidation state of metal element or cation greater than (II), the symbol $X_4$ of FIG. 2 represents an anion, preferably OH— or Cl— when the oxidation state is (III).

FIGURE 1

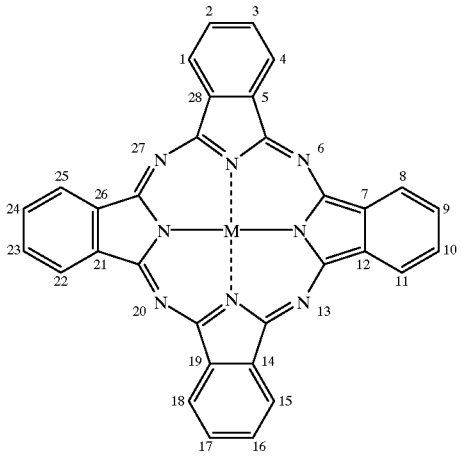

FIGURE 2

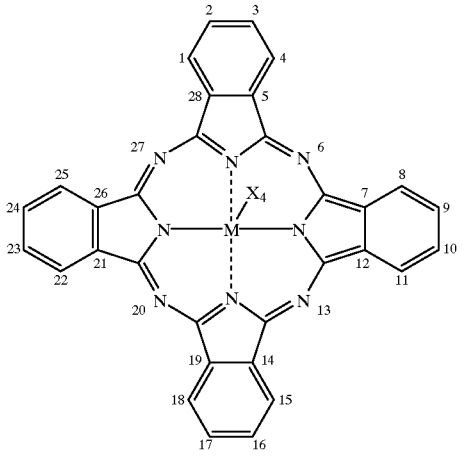

Bleaching Agent

The bleaching composition herein comprises of from 0.1% by weight of a bleaching agent capable of providing an peroxyacid bleach. Preferably, the bleaching composition comprises of from 0.5% to 50% by weight of the bleaching agent, more preferably from 1% to 25%, or even from 1.5% to 10%.

The bleaching composition is preferably comprised in a cleaning composition, preferably a laundry or dish washing detergent composition, such that the bleaching agent is present at a level of from 0.1% to 25% by weight, preferably from 0.5% to 20% or even from 1% to 15% by weight of the cleaning composition.

The bleaching composition may comprise any of the additional ingredient as described herein. Preferred may be that the bleaching composition comprises the bleaching agent intimately mixed with a carrier material or a coating material or mixtures thereof.

Preferably, the bleaching agent comprises a preformed peroxyacid compound or even more preferably a peroxyacid bleach precursor, capable of providing a peroxvacid compound.

Preferably, the bleaching composition comprises a peroxyacid precursor and a hydrogen peroxide source. The production of the peroxyacid occurs by an in situ reaction of the precursor with a source of hydrogen peroxide. Compositions containing mixtures of a hydrogen peroxide source and organic peroxyacid precursor in combination with a preformed organic peroxyacid are also envisaged.

It may be preferred that the bleaching composition comprises more than one peroxyacid compound, preferably precursors, preferably at least one peroxyacid compound or preferably peroxyacid precursor providing a peroxyacid compound comprising at least 7 carbon atoms and at least one peroxyacid compound or preferably peroxyacid precursor providing a peroxyacid compound comprising from 2 to 6 carbon atoms.

Peroxyacid Bleach Precursor

Peroxyacid bleach precursors are compounds which can react with hydrogen peroxide in a perhydrolysis reaction to produce a peroxyacid. Generally peroxyacid precursors may be represented as

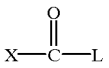

where L is a leaving group and X is essentially any functionality, such that on perhydroloysis the structure of the peroxyacid produced is

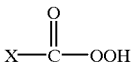

Suitable peroxyacid bleach precursor compounds typically contain one or more N— or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle).

However, if L is too reactive, this activator will be difficult to stabilize for use in a bleaching composition.

Preferred L groups are selected from the group consisting of:

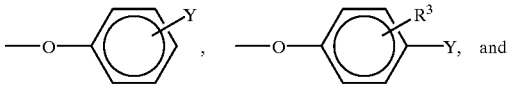

-continued

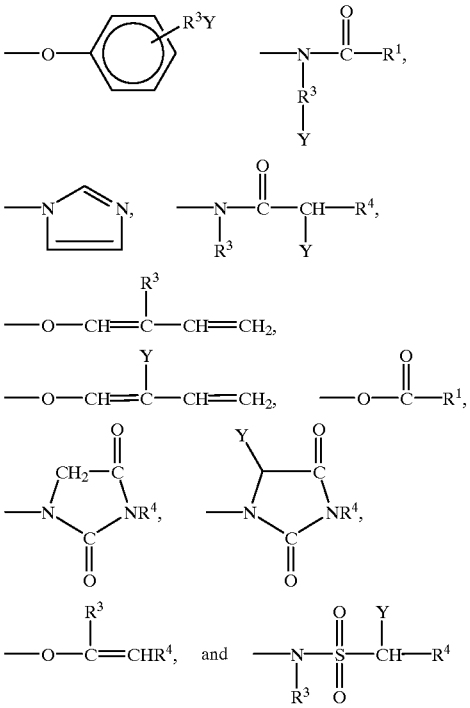

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O←N(R^3)_3$ and most preferably $—SO_3^{-M+}$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. The TAED is preferably not present in the agglomerated particle of the present invention, but preferably present in the detergent composition, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Peroxyacid Precursors

Amide substituted alkyl peroxyacid precursor compounds are suitable herein, including those of the following general formulae:

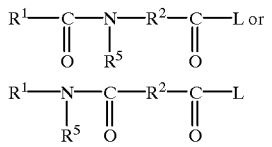

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group; $R^1$ may be straight chain or branched alkyl substituted aryl or alkylaryl containing branching, substitution, or both and may be sourced from either synthetic sources or natural sources including for example, tallow fat. Analogous structural variations are permissible for $R^2$. $R^2$ can include alkyl, aryl, wherein said $R^2$ may also contain halogen, nitrogen, sulphur and other typical substituent groups or organic compounds. $R^5$ is preferably H or methyl. $R^1$ and $R^5$ should preferably not contain more than 18 carbon atoms total. Amide substituted bleach activator compounds of this type are described in EP-A-0170386.

Preferred examples of bleach precursors of this type include amide substituted peroxyacid precursor compounds selected from (6-octanamido-caproyl)oxybenzenesulfonate, (6-decanamido-caproyl)oxybenzene-sulfonate, and the highly preferred (6-nonanamidocaproyl) oxybenzene sulfonate, and mixtures thereof as described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucosc, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the solid detergent compositions as a salt with a suitable anion, such as a halide ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528: U.K. 1,382,594; EP 475,512, 458,396 and 284,292; and in JP 87-318,332.

Examples of preferred cationic peroxyacid precursors are described in UK Patent Application No. 9407944.9 and U.S. patent application Ser. Nos. 08/298,903, 08/298,650, 08/298,904 and 08/298,906.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides. Preferred cationic peroxyacid precursors of the N-acylated caprolactam class include the trialkyl ammonium methylene benzoyl caprolactams and the trialkyl ammonium methylene alkyl caprolactams.

Benzoxazin Organic Peroxyacid Precursors

Also suitable are precursor compounds of the benzoxazin-type, as disclosed for example in EP-A-332,294 and EP-A-482,807, particularly those having the formula:

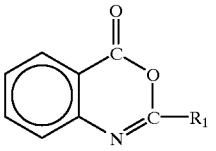

wherein $R_1$ is H, alkyl, alkaryl, aryl, or arylalkyl.

Preformed Organic Peroxyacid

A preferred class of organic peroxyacid compounds are the amide substituted compounds of the following general formulae:

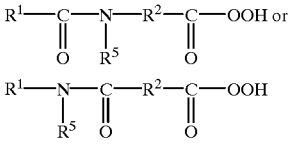

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Hydrogen Peroxide Sources

Inorganic perhydrate salts are a preferred source of hydrogen peroxide for use in the bleaching compositions of the invention or the cleaning compositions comprising the bleaching composition.

These salts are normally incorporated in the form of the alkali metal, preferably sodium salt at a level of from 1% to 40% by weight, more preferably from 2% to 30% by weight and most preferably from 5% to 25% by weight of the bleaching or cleaning compositions.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Sodium perborate is a preferred perhydrate salt and can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Potassium peroxymonopersulfate is another inorganic perhydrate salt of use in the detergent compositions herein.

The hydrogen peroxide sources may be coated, preferably with inorganic salts, organic acids or salts, silicates or mixtures thereof.

Additional Ingredients

The bleaching compositions in accordance with the present invention or the cleaning compositions herein may also contain additional ingredients. The precise nature of these additional ingredients, and levels of incorporation thereof will depend on the physical form of the compositions and the precise nature of the washing operation for which it is to be used.

The compositions preferably contain one or more additional components selected from surfactants, builders, sequestrants, bleach, bleach precursors, bleach catalysts, organic polymeric compounds, additional enzymes, suds suppressors, lime soap dispersants, soil suspension and anti-redeposition agents, soil releasing agents, perfumes and corrosion inhibitors.

Highly preferred in the compositions herein may be chelating agents, capable of complexing or binding heavy metal ions. It has been found that chelating agents can further improve the solubility of the photo-bleaching agents. It is believed that this may be due to the chelating agents forming a complex with the heavy metal ins comprised in the photo-bleaching agent. Any chelating, agent described herein may be suitable in the compositions herein.

The levels of the ingredients, when described herein are in % by weight of the cleaning composition, comprising the bleaching composition of the invention, unless otherwise stated.

Surfactant

The bleaching compositions or cleaning compositions preferably contain one or more surfactants selected from anionic, nonionic, cationic, ampholytic, amphoteric and zwitterionic surfactants and mixtures thereof.

A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitterionic surfactants are generally used in combination with one or more anionic and/or nonionic surfactants.

Anionic Surfactant

The compositions preferably comprise an anionic surfactant. Essentially any anionic surfactants useful for detersive purposes can be comprised in the detergent composition. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate and sulfonate surfactants are preferred.

Highly preferred are surfactants systems comprising a sulfonate and a sulfate surfactant, preferably a linear or branched alkyl benzene sulfonate and alkyl ethoxylsulfates, as described herein, preferably combined with a cationic surfactants as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/or sulfonate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$–$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R—CON $(R^1)CH_2COOM$, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein : R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and —$(C_2H_4O)_xH$, where x is in the range of from 1 to 3.

Nonionic Alkylpolysaccharide Surfactant

Suitable alkylpolysaccharides for use herein are disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms, n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10\text{-}18}$ acylamido alkyl dimethylamine oxide.

A suitable example of an alkyl aphodicarboxylic acid is Miranol™ C2M Conc. manufactured by Miranol, Inc., Dayton, N.J.

Zwitterionic Surfactant

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO$— wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12\text{-}18}$ dimethylammonio hexanoate and the $C_{10\text{-}18}$ acylamidopropane (or ethane) dimethyl (or diethyl) betaines. Complex betaine surfactants are also suitable for use herein.

Cationic Surfactants

Suitable cationic surfactants to be used in the detergent herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants.

Suitable cationic ester surfactants, including choline ester surfactants, have for example been disclosed in U.S. Pat. Nos. 4,228,042, 4,239,660 and 4,260,529.

Cationic Mono-alkoxylated Amine Surfactants

Highly preferred herein are cationic mono-alkoxylated amine surfactant preferably of the general formula I:

(I)

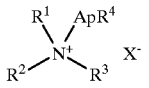

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are $—CH_2CH_2OH$, $—CH_2CH_2CH_2OH$, $—CH_2CH(CH_3)OH$ and $—CH(CH_3)CH_2OH$, with $—CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

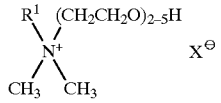

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent compositions of the invention is preferably from 0. 1% to 20%, more preferably from 0.2% to 7%, most preferably from 0.3% to 3.0% by weight of the cleaning composition.

Cationic Bis-alkoxylated Amine Surfactant

The cationic bis-alkoxylated amine surfactant preferably has the general formula II:

(II)

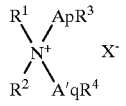

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e. $—CH_2CH_2O—$), propoxy, butoxy and mixtures thereof, p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

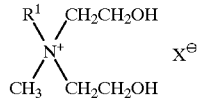

wherein $R^1$ is $C_{10}$14 $C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

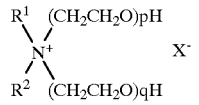

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Effervescence Source

In particular solid compositions herein may comprise an effervescence source, preferably comprise an acid source, such that the acid source is capable of reacting with an alkalinity system, in the presence of water to produce a gas.

The acid source is preferably present at a level of from 0.1% to 50%, more preferably from 0.5% to 25%, even more preferably from 1% to 12%, even more preferably from 1% to 7%, most preferably from 2% to 5% by weight of the cleaning composition. It can be preferred that the source of acidity is present in the range of about 1% to about 3%, most preferably about 3% by weight of the cleaning composition.

The acid source may be any suitable organic, mineral or inorganic acid, or a derivative thereof, or a mixture thereof. The acid source may be a mono-, bi- or tri-protonic acid. Preferred derivatives include a salt or ester of the acid. The source of acidity is preferably non-hygroscopic, which can improve storage stability. However, a monohydrate acidic source can be useful herein. Organic acids and their derivatives are preferred. The acid is preferably water-soluble. Suitable acids include citric, malic, maleic, glutaric, tartaric acid, succinic or adipic acid, monosodium phosphate, sodium hydrogen sulfate, boric acid, or a salt or an ester thereof.

Examples of alkalinity species include carbonate, bicarbonate, hydroxide, the various silicate anions, percarbonate, perborates, perphosphates, persulfate and persilicate. Such alkalinity species can be formed for example, when alkaline salts selected from alkali metal or alkaline earth carbonate, bicarbonate, hydroxide or silicate, including crystalline layered silicate, salts and percarbonate, perborates, perphosphates, persulfate and persilicate salts and any mixtures thereof are dissolved in water.

Examples of carbonates are the alkaline earth and alkali metal carbonates, including sodium carbonate and sesquicarbonate and any mixtures thereof with ultra-fine calcium carbonate such as are disclosed in German Patent Application No. 2,321,001 published on Nov. 15, 1973.

Water-soluble Builder Compound

The compositions preferably contain a water-soluble builder compound, typically present in detergent compositions at a level of from 1% to 80% by weight, preferably from 10% to 70% by weight, most preferably from 20% to 60% by weight of the composition.

Suitable water-soluble builder compounds include the water soluble monomeric polycarboxylates, or their acid forms, including citric acid or citrate salts, homo or copolymeric polycarboxylic acids or their salts in which the polycarboxylic acid comprises at least two carboxylic radicals separated from each other by not more that two carbon atoms, borates, phosphates, and mixtures of any of the foregoing.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

Partially Soluble or Insoluble Builder Compound

The compositions may contain a partially soluble or insoluble builder compound, typically present in detergent compositions at a level of from 1% to 80% by weight, preferably from 10% to 70% by weight, most preferably from 20% to 60% weight of the composition.

Examples of largely water insoluble builders include the sodium aluminosilicates.

Suitable aluminosilicate zeolites have the unit cell formula $Na_z[(AlO_2)_z(SiO_2)y]. xH_2O$ wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 18% to 22% water in bound form.

The aluminosilicate zeolites can be naturally occurring materials but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula $$Na_{12}.[(AlO_2)_{12}(SiO_2)_{12}].xH_2O$$

wherein x is from 20 to 30, especially 27. Zeolite X has the formula $Na_{86}\ [(AlO_2)_{86}(SiO_2)_{106}].276\ H_2O$.

Another preferred aluminosilicate zeolite is zeolite MAP builder. The zeolite MAP can be present at a level of from 1% to 80%, more preferably from 15% to 40% by weight of the compositions.

Zeolite MAP is described in EP 384070A (Unilever).

Another preferred builder can be an crystalline layered silicate material, preferably of the formula $Na_2Si_2O_5$, preferably as sold by Clariant under the trade name SKS-6, having a α, β, δ, or mixtures thereof, -configuration.

Preferably the crystalline layered silicate material is present at a level of from 0.1% to 10%, more preferably from 0.25% to 7.5% and most preferably from 0.5% to 5% by weight of the compositions.

Heavy Metal Ion Sequestrant

The compositions preferably contain as an optional component a heavy metal ion sequestrant, which act to sequester (chelate) heavy metal ions. These components may also have calcium and magnesium chelation capacity, but preferentially they show selectivity to binding heavy metal ions such as iron manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Suitable heavy metal ion sequestrants for use herein include organic phosphonates, such as the amino alkylene poly(alkylene phosphonates), alkali metal ethane 1-hydroxy disphosphonates and nitrilo trimethylene phosphonates.

Preferred among the above species are diethylene triamine penta(methylene phosphonate), ethylene diamine tri (methylene phosphonate) hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof. Especially preferred is ethylenediamine-N,N'-disuccinic acid (EDDS) or the alkali metal, alkaline earth metal, ammonium, or substituted ammonium salts thereof, or mixtures thereof.

Other suitable heavy metal ion sequestrants for use herein are described in EP-A-317,542, EP-A-399,133, EP-A-516, 102 EP-A-509,382, EP-A-476,257, EP-A-510,331 and EP-A-528,859.

Enzymes

The compositions may comprise one or more enzymes.

Preferred additional enzymatic materials include the commercially available enzymes. Said enzymes include enzymes selected from lipases, cellulases, hemicellulases, peroxidases, proteases, gluco-amylases, amylases, xylanascs, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase or mixtures thereof.

A preferred combination of additional enzymes in a composition according to the present invention comprises a mixture of conventional applicable enzymes such as lipase, protease, amylase, cutinase and/or cellulase in conjunction with one or more plant cell wall degrading enzymes. Suitable enzymes are exemplified in U.S. Pat. Nos. 3,519,570 and 3,533,139.

Suitable proteases are the subtilisins which are obtained from particular strains of *B. subtilis* and *B. licheniformis* (subtilisin BPN and BPN'). One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE®, DURAZYM® and SAVINASE® from Novo and MAXATASE®, MAXACAL®, PROPERASE® and MAXAPEM® (protein engineered Maxacal) from Gist-Brocades. Proteolytic enzymes also encompass modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine protealytic enzyme which is called "Protease A" herein. Suitable is what is called herein "Protease C", which is a variant of an alkaline serine protease from Bacillus in which lysine replaced arginine at position 27, tyrosine replaced valine at position 104, serine replaced asparagine at position 123, and alanine replaced threonine at position 274. Protease C is described in EP 90915958:4, corresponding to WO 91/06637, Published May 16, 1991. Genetically modified variants, particularly of Protease C, are also included herein.

A preferred protease referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in WO95/10591 and in the patent application of C. Ghosh, et al, "Bleaching Compositions Comprising Protease Enzymes" having U.S. Ser. No. 08/322,677, filed Oct. 13, 1994.

Also suitable for the present invention are proteases described in patent applications EP 251 446 and WO 91/06637, protease BLAP® described in WO91/02792 and their variants described in WO 95/23221.

See also a high pH protease from Bacillus sp. NCIMB 40338 described in WO 93/18140 A to Novo. Enzymatic detergents comprising protease, one or more other enzymes, and a reversible protease inhibitor are described in WO 92/03529 A to Novo. When desired, a protease having decreased adsorption and increased hydrolysis is available as described in WO 95/07791 to Procter & Gamble. A recombinant trypsin-like protease for detergents suitable herein is described in WO 94/25583 to Novo. Other suitable proteases are described in EP 516 200 by Unilever.

One or a mixture of proteolytic enzymes may be incorporated in the compositions of the present invention, generally at a level of from 0.0001% to 2%, preferably from 0.001% to 0.2%, more preferably from 0.005% to 0.1% pure enzyme by weight of the composition.

If present in the detergent compositions of the present invention, the lipolytic enzyme component is generally present at levels of from 0.00005% to 2% of active enzyme by weight of the detergent composition, preferably 0.001% to 1% by weight, most preferably from 0.0002% to 0.05% by weight active enzyme in the detergent composition.

Suitable lipolytic enzymes for use in the present invention include those produced by micro-organisms of the Pseudomonas group, such as *Pseudomnonas stutzeri* ATCC 19.154, as disclosed in British Patent 1,372,034. Suitable lipases include those which show a positive immunological cross-section with the antibody of the lipase produced by the microorganism *Pseudomonas hisorescent* IAM 1057. This lipase is available from Amano Pharmaceutical Co. Ltd., Nagoya, Japan, under the trade name Lipase P "Amano," hereinafter referred to as "Amano-P." Other suitable commercial lipases include Amano-CES, lipases ex *Chromobacier viscosum,* e.g. *Chromobacier viscosum* var. lipolyticum NRRLB 3673, commercially available from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli.* Especially suitable lipases are lipases such as M1 Lipase$^R$ and Lipomax$^R$ (Gist-Brocades) and Lipolase$^R$ and Lipolase Ultra$^R$(Novo) which have found to be very effective when used in combination with the compositions of the present invention. Also suitable are the lipolytic enzymes described in EP 258 068, WO 92/05249 and WO 95/22615 by Novo Nordisk and in WO 94/03578, WO 95/35381 and WO 96/00292 by Unilever.

Also suitable are cutinases [EC 3.1.1.50] which can be considered as a special kind of lipase, namely lipases which do not require interfacial activation. Addition of cutinases to detergent compositions have been described in e.g. WO-A-88/09367 (Genencor); WO 90/09446 (Plant Genetic System) and WO 94/14963 and WO 94/14964 (Unilever). The LIPOLASE enzyme derived from Humicola lanuginosa and commercially available from Novo (see also EPO 341,947) is a preferred lipase for use in the present invention.

Another preferred lipase for use in the present invention is D96L lipolytic enzyme variant of the native lipase derived from Humicola lanuginosa. Most preferably the Humicola lanuginosa strain DSM 4106 is used.

By D96L lipolytic enzyme variant is meant the lipase variant as described in patent application WO 92/05249 in which the native lipase ex Humicola lanuginosa has the aspartic acid (D) residue at position 96 changed to Leucine (L). According to this nomenclature said substitution of aspartic acid to Leucine in position 96 is shown as: D96L. To determine the activity of the enzyme D96L the standard LU assay may be used (Analytical method, internal Novo Nordisk number AF 95/6-GB 1991.02.07). A substrate for D96L was prepared by emulsifying glycerine tributyrate (Merck) using gum-arabic as emulsifier. Lipase activity is assayed at pH 7 using pH stat. method.

The compositions may also contain one or a mixture of more than one amylase enzyme (α and/or β). WO094/02597, Novo Nordisk A/S published Feb. 03, 1994, describes cleaning compositions which incorporate mutant amylases. See also WO95/10603, Novo Nordisk A/S, published Apr. 20, 1995. Other amylases known for use in cleaning compositions include both α- and β-amylases. α-Amylases are known in the art and include those disclosed in U.S. Pat. No. 5,003,257; EP 252,666; WO/91/00353; FR 2,676,456; EP 285,123; EP 525,610; EP 368.341; and British Patent specification no. 1,296,839 (Novo). Other suitable amylases are stability-enhanced amylases described in WO94/18314, published Aug. 18, 1994 and WO96/05295, Genencor, published Feb. 22, 1996 and amylase variants having additional modification in the immediate parent available from Novo Nordisk A/S, disclosed in WO 95/10603, published April 95. Also suitable are amylases described in EP 277 216, WO95/26397 and WO96/23873 (all by Novo Nordisk).

Examples of commercial α-amylases products are Purafect Ox Am® from Genencor and Termamyl®, Ban®, Fungamyl® and Duramyl®, all available from Novo Nordisk A/S Denmark. WO95/26397 describes other suitable amylases: α-amylases characterised by having a specific activity at least 25% higher than the specific activity of Termamyl® at a temperature range of 25° C. to 55° C. and at a pH value in the range of 8 to 10, measured by the Phadebas® α-amylase activity assay. Suitable are variants of the above enzymes, described in WO96/23873 (Novo Nordisk). Other preferred amylolytic enzymes with improved properties with respect to the activity level and the combination of thermostability and a higher activity level are described in WO95/35382.

The amylolytic enzymes if present are generally incorporated in the compositions at a level of from 0.0001% to 2%, preferably from 0.00018% to 0.06%, more preferably from 0.00024% to 0.048% pure enzyme by weight of the composition.

The compositions of the invention may additionally incorporate one or more cellulase enzymes. Suitable cellulases include both bacterial or fungal cellulases. Preferably, they will have a pH optimum of between 5 and 12 and an activity above 50 CEVU (Cellulose Viscosity Unit). Suitable cellulases are disclosed in U.S. Pat. No. 4,435,307, Barbesgoard et al, J61078384 and WO96/02653 which disclose fungal cellulases produced respectively from Humicola insolens, Trichoderma, Thielavia and Sporotrichum. EP 739 982 describes cellulases isolated from novel Bacillus species. Suitable cellulases are also disclosed in GB-A-2.075.028; GB-A-2.095.275; DE-OS-2.247.832 and WO95/26398.

Examples of such cellulases are cellulases produced by a strain of Humicola insolens (Humicola grisea var. thermoidea), particularly the Humicola strain DSM 1800. Other suitable cellulases are cellulases originated from Humicola insolens having a molecular weight of about 50 KDa. an isoelectric point of 5.5 and containing 415 amino acids; and a ~43 kD endoglucanase derived from Humicola insolens, DSM 1800, exhibiting cellulase activity; a preferred endoglucanase component has the amino acid sequence disclosed in PCT Patent Application No. WO 91/17243. Also suitable cellulases are the EGIII cellulases from Trichoderma longibrachiatum described in WO94/21 801, Genencor, published Sep. 29, 1994. Especially suitable cellulases are the cellulases having color care benefits. Examples of such cellulases are cellulases described in European patent application No. 91202879.2, filed Nov. 6. 1991 (Novo). Carezyme and Celluzyme (Novo Nordisk A/S) are especially useful. See also WO91/17244 and WO91/21801. Other suitable cellulases for fabric care and/or cleaning properties are described in WO96/34092, WO96/17994 and WO95/24471.

Peroxidase enzymes may also be incorporated into the compositions herein. Peroxidasis are used in combination with oxygen sources, e.g. percarbonate, perborate, persulfate, hydrogen peroxide, etc. They are used for "solution bleaching", i.e. to prevent transfer of dyes or pigments removed from substrates during wash operations to other substrates in the wash solution. Peroxidase enzymes arc known in the art, and include, for example, horseradish peroxidase, ligninase and haloperoxidase such as chloro- and bromo-peroxidase. Peroxidase-containing detergent compositions are disclosed, for example, in PCT International Application WO 89/099813, WO89/09813 and in European Patent application EP No. 91202882.6, filed on Nov. 6, 1991 and EP No. 96870013.8, filed Feb. 20, 1996. Also suitable is the laccase enzyme.

Preferred enhancers are substituted phenthiazine and phenoxasine 10-Phenothiazinepropionicacid (PPT), 10-ethylphenothiazine-4-carboxylic acid (EPC), 10-phenoxazinepropionic acid (POP) and 10-methylphenoxazine (described in WO 94/12621) and substituted syringates (C3–C5 substituted alkyl syringates) and phenols. Sodium percarbonate or perborate are preferred sources of hydrogen peroxide.

Said cellulases and/or peroxidases, if present, are normally incorporated in the composition at levels from 0.0001% to 2% of active enzyme by weight of the detergent composition.

Said additional enzymes, when present, are normally incorporated in the composition at levels from 0.0001% to 2% of active enzyme by weight of the detergent composition. The additional enzymes can be added as separate single ingredients (prills, granulates, stabilized liquids, etc. containing one enzyme) or as mixtures of two or more enzymes (e.g. cogranulates).

Additional Organic Polymeric Compound

Additional organic polymeric compounds, not present in the photo-bleaching agent or integrated with the photo-bleaching component herein, may be present in the compositions herein. By organic polymeric compound is meant any polymeric organic compound commonly used as dispersants, anti-redeposition or soil suspension agents in detergent compositions, including any of the high molecular weight organic polymeric compounds described as clay flocculating agents herein.

Such an organic polymeric compound is generally incorporated in the compositions at a level of from 0.1% to 30%, preferably from 0.5% to 15%, most preferably from 1% to 10% by weight of the compositions.

Suitable polymers are disclosed in GB-A-1,596,756. Examples of such salts are polyacrylic acid or polyacrylates of MWt 1000–5000 and their copolymers with maleic anhydride, such copolymers having a molecular weight of from 2000 to 100,000, especially 40,000 to 80,000. Polymaleates or polymaleic acid polymers and salts thereof are also suitable examples.

Polyamino compounds useful herein include those derived from aspartic acid including polyaspartic acid and such as those disclosed in EP-A-305282, EP-A-305283 and EP-A-351629.

Terpolymers containing monomer units selected from maleic acid, acrylic acid, aspartic acid and vinyl alcohol or acetate, particularly those having an average molecular weight of from 1,000 to 30,000, preferably 3,000 to 10,000, are also suitable for incorporation into the compositions of the present invention.

Other organic polymeric compounds suitable for incorporation in the detergent compositions of the present invention include cellulose derivatives such as methylcellulose, carboxymethylcellulose, hydroxypropylmethylcellulose, ethylhydroxyethylcellulose and hydroxyethylcellulose.

Further useful organic polymeric compounds are the polyethylene glycols, particularly those of molecular weight 1000 to 10000, more particularly 2000 to 8000 and most preferably about 4000.

Cationic Soil Removal/anti-redeposition Compounds

The composition herein may comprise water-soluble cationic ethoxylated amine compounds with particulate soil/clay-soil removal and/or anti-redeposition properties. These cationic compounds are described in more detail in EP-B-111965, U.S. Pat. Nos. 4,659,802 and 4,664,848. Particularly preferred of these cationic compounds are ethoxylated cationic monoamines, diamines or triamines. These compounds where present in the composition, are generally present in an amount of from 0.01 to 30% by weight, preferably 0.05 to 10% by weight.

Suds Suppressing System

It can be preferred that the cleaning composition require low-sudsing, and that thus incorporation of suds suppressant for foam control are desirable. They are preferably present in amounts no greater than 2.5% and most preferably in amounts no greater than 1.5% or even no greater than 0.5% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Polymeric Dye Transfer Inhibiting Agents

The compositions herein may also comprise from 0.01% to 10%, preferably from 0.05% to 0.5% by weight of additional polymeric compounds, not comprised in the photo-bleaching agent of the compositions of the invention, which act as dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidone polymers or combinations thereof, whereby these polymers can be cross-linked polymers.

Optical Brightener

The compositions herein may optionally contain from about 0.005% to 5% by weight of certain types of hydrophilic optical brighteners.

Hydrophilic optical brighteners useful herein include those having the structural formula:

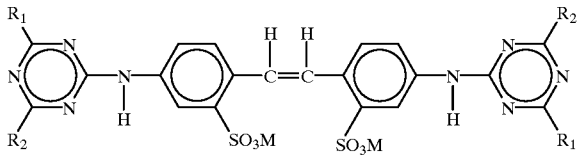

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxycthyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX by Ciba Geigy Corporation.

Polymeric Soil Release Agent

Known polymeric soil release agents, hereinafter "SRA", can optionally be employed in the present compositions. If utilized, SRA's will generally comprise from 0.01% to 10.0%, typically from 0.1% to 5%, preferably from 0.2% to 3.0% by weight, of the compositions.

Suitable SRA's include a sulfonated product of a substantially linear ester oligomer comprised of an oligomeric or polymeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink; the nonionic-capped block polyester oligomeric compounds of U.S. Pat. No. 4,702,857, Oct. 27, 1987 to Gosselink; and the anionic, especially sulfoaroyl, end-capped terephthalate esters of U.S. Pat. No. 4,877,896, Oct. 31, 1989 to Maldonado, Gosselink et al.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Other Optional Ingredients

Other optional ingredients suitable for inclusion in the compositions of the invention include perfumes, colours and filler salts, including speckles, with sodium sulfate being a preferred filler salt.

Near Neutral Wash pH Detergent Formulation

While the cleaning compositions are operative within a wide range of wash pHs (e.g. from about 5 to about 12), they are particularly suitable when formulated to provide a near neutral wash pH, i.e. an initial pH of from about 7.0 to about 10.5 at a concentration of from about 0.1 to about 2% by weight in water at 20° C. Near neutral wash pH formulations are better for enzyme stability and for preventing stains from setting. In such formulations, the wash pH is preferably from about 7.0 to about 10.5, more preferably from about 8.0 to about 10.5, most preferably from 8.0 to 9.0.

Preferred near neutral wash pH detergent formulations are disclosed to European Patent Application 83.200688.6, filed May 16, 1983. J. H. M. Wertz and P. C. E. Goffinet.

Highly preferred cleaning compositions of this type also preferably contain from about 2 to about 10% by weight of citric acid and minor amounts (e.g., less than about 20% by weight) of neutralizing agents, buffering agents, phase regulants, hydrotropes, enzymes, enzyme stabilizing agents, polyacids, suds regulants, opacifiers, anti-oxidants, bactericides, dyes, perfumes and brighteners, such as those described in U.S. Pat. No. 4,285,841 to Barrat et al., issued Aug. 25, 1981 (herein incorporated by reference).

Form of the Compositions

The bleaching compositions in accordance with the invention and the cleaning compositions herein can take a variety of physical forms including granular, tablet, flake, pastille and bar and liquid forms. Liquids may be aqueous or non-aqueous and may be in the form of a gel. The cleaning compositions may be pre-treatment compositions or may be conventional washing detergents. It may be preferred that the cleaning compositions are particularly granular detergent compositions, preferably the so-called concentrated, adapted to be added to a washing machine by means of a dispensing device placed in the machine drum with the soiled fabric load.

Such granular detergent compositions or components thereof in accordance with the present invention can be made via a variety of methods. including spray-drying, dry-mixing, extrusion, agglomerating and granulation.

The bleaching compositions herein can be added to the other components of the cleaning compositions as a dry-add, mixed with the other component and agglomerated, extruded and/or spray-dried.

The bleaching agent and the photo-bleaching agent may be premixed prior to addition to the other ingredients of the cleaning composition or the bleaching composition; the bleaching composition may also be pre-mixed with one or more of the additional ingredients of the cleaning composition, prior to further addition of the remaining ingredients.

The compositions can also be used in or in combination with bleach additive compositions, for example comprising chlorine bleach.

It may be preferred that the mean particle size of the components of granular compositions in accordance with the invention is such that no more than 15% of the particles are greater than 1.8 mm in diameter and not more than 15% of the particles are less than 0.25 mm in diameter. However, it may be preferred that the composition comprises particles of mean particle size at least 0.8 mm, more preferably at least 1.0 mm and most preferably from 1.0, or 1.5 to 2.5 mm. Most preferably at least 95% of the particles will have such a mean particle size. Such particles are preferably prepared by an extrusion process.

The term mean particle size as defined herein is calculated by sieving a sample of the composition into a number of fractions (typically 5 fractions) on a series of sieves, preferably Tyler sieves. The weight fractions thereby obtained are plotted against the aperture size of the sieves. The mean particle size is taken to be the aperture size through which 50% by weight of the sample would pass.

Compacted solid detergents may be manufactured using any suitable compacting process, such as tabletting, briquetting or extrusion, preferably tabletting.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liters, as are typical product dosages and wash solution volumes commonly employed in conventional machine laundry methods. Dosage is dependent upon the particular conditions such as water hardness and degree of soiling of the soiled laundry.

The detergent composition may be dispensed for example, from the drawer dispenser of a washing machine or may be sprinkled over the soiled laundry placed in the machine.

In one use aspect a dispensing device is employed in the washing method. Preferred dispensing devices are reusable and are designed in such a way that container integrity is maintained in both the dry state and during the wash cycle. Especially preferred dispensing devices for use with the composition of the invention have been described in the following patents; GB-B-2, 157, 717, GB-B-2, 157, 718, EP-A-0201376, EP-A-0288345 and EP-A-0288346. An article by J. Bland published in Manufacturing Chemist, November 1989, pages 41–46 also describes especially preferred dispensing devices for use with granular laundry products which are of a type commonly know as the "granulette". Another preferred dispensing device for use with the compositions of this invention is disclosed in PCT Patent Application No. WO94/11562.

Especially preferred dispensing devices are disclosed in European Patent Application Publication Nos. 0343069 & 0343070. Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

Machine Dishwashing Method

Any suitable methods for machine dishwashing or cleaning soiled tableware, particularly soiled silverware are envisaged.

A preferred machine dishwashing method comprises treating soiled articles selected from crockery, glassware, hollowware, silverware and cutlery and mixtures thereof, with an aqueous liquid having dissolved or dispensed therein an effective amount of a machine dishwashing composition in accord with the invention. By an effective amount of the machine dishwashing composition it is meant from 8 g to 60 g of product dissolved or dispersed in a wash solution of volume from 3 to 10 liters, as are typical product dosages and wash solution volumes commonly employed in conventional machine dishwashing methods.

ABBREVIATIONS USED IN EXAMPLES

In the detergent compositions, the abbreviated component identifications have the following meanings:

| | |
|---|---|
| LAS | Sodium linear $C_{11-13}$ alkyl benzene sulfonate |
| TAS | Sodium tallow alkyl sulfate |
| CxyAS | Sodium $C_{1x}$—$C_{1y}$ alkyl sulfate |
| C46SAS | Sodium $C_{14}$—$C_{16}$ secondary (2,3) alkyl sulfate |
| CxyEzS | Sodium $C_{1x}$–$C_{1y}$ alkyl sulfate condensed with z moles of ethylene oxide |
| CxyEz | $C_{1x}$–$C_{1y}$ predominantly linear primary alcohol condensed with an average of z moles of ethylene oxide |
| QAS | $R_2.N^+(CH_3)_2(C_2H_4OH)$ with $R_2 = C_{12}$–$C_{14}$ |
| QAS 1 | $R_2.N^+(CH_3)_2(C_2H_4OH)$ with $R_2 = C_8$–$C_{11}$ |
| SADS | Sodium $C_{14}$—$C_{22}$ alkyl disulfate of formula 2-(R).$C_4H_7$.-1,4-$(SO_4—)_2$ where R = $C_{10}$–$C_{18}$ |
| SADE2S | Sodium $C_{13}$–$C_{22}$ alkyl disulfate of formula 2-(R).$C_4H_7$.-1,4-$(SO_4—)_2$ where R = $C_{10}$—$C_{18}$, condensed with z moles of ethylene oxide |
| MBAS | $C_{12}$–$C_{18}$ midbranched alkyl sulphate having an average of 1.5 ethyl or methyl branching groups |

-continued

| | |
|---|---|
| MES | x-sulpho methylester of $C_{18}$ fatty acid |
| APA | $C_8$—$C_{10}$ amido propyl dimethyl amine |
| Soap | Sodium linear alkyl carboxylate derived from an 80/20 mixture of tallow and coconut fatty acids |
| STS | Sodium toluene sulphonate |
| CFAA | $C_{12}$—$C_{14}$ (coco) alkyl N-methyl glucamide |
| TFAA | $C_{16}$—$C_{18}$ alkyl N-methyl glucamide |
| TPKFA | $C_{16}$—$C_{18}$ topped whole cut fatty acids |
| STPP | Anhydrous sodium tripolyphosphate |
| TSPP | Tetrasodium pyrophosphate |
| Zeolite A | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |
| NaSKS-6 | Crystalline layered silicate of formula $\delta$-$Na_2Si_2O_5$ |
| Citric acid | Anhydrous citric acid |
| Borate | Sodium borate |
| Carbonate | Anydrous sodium carbonate with a particle size between 200 $\mu$m and 900 $\mu$m |
| Bicarbonate | Anhydrous sodium bicarbonate with a particle size distribution between 400 $\mu$m and 1200 $\mu$m |
| Silicate | Amorphous sodium silicate ($SiO_2$:$Na_2O$ = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 $\mu$m and 850 $\mu$m |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Amylase II | Amylolytic enzyme, as disclosed in PCT/US9703635 |
| Lipase | Lipolytic enzyme, having 2.0% by weight of active enzyme, sold by NOVO Industries A/S under the tradename Lipolase |
| Lipase (1) | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| DOBS | Decanoyl oxybenzene sulfonate in the form of the sodium salt |
| DPDA | Diperoxydodecanedioc acid |
| NOBS | Nonanoyloxybenzene sulfonate in the form of the sodium salt |
| NACA-OBS | (6-nonamidocaproyl) oxybenzene sulfonate |
| LOBS | Dodecanoyloxybenzene sulfonate in the form of the sodium salt |
| DOBS | Decanoyloxybenzene sulfonate in the form of the sodium salt |
| DOBA | Decanoyl oxybenzoic acid |
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| Photo-bleach 1 | agent comprising zinc phthalocyanine and polyvinylpyrrolidinone of average molecular weight of 30,000 to 50,000, at a weight ratio of 1:80 to 1:120, encapsulated with starch and with a sugar derivative |
| Photo-bleach 2 | agent comprising, at a weight ratio of 1:80 to 1:120, an alumino phthalocyanine and a copolymer of polyvinylpyrrolidinone and polyvinylimidazole, of average molecular weight of from 30,000 to 50,000 |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidosole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | bis($(C_2H_5O)(C_2H_4O)_n$) $(CH_3)$—$N^+$—$C_6H_{12}$—$N^+$—$(CH_3)$ bis($(C_2H_5O)$—$(C_2H_4O))_n$, wherein n = from 20 to 30 |
| SRP 1 | Anionically end capped poly esters |
| SRP 2 | Diethoxylated poly (1,2 propylene terephtalate) short block polymer |
| PEI | Polyethyleneimine with an average molecular weight of 1800 and an average ethoxylation degree of 7 ethyleneoxy residues per nitrogen |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaff under the tradename Lytron 621 |
| Wax | Paraffin wax |

Compositions described hereinafter, the abbreviated component identifications have the following meanings:

EXAMPLE 1

| | A | B | C | D | E | F |
|---|---|---|---|---|---|---|
| Agglomerate | | | | | | |
| LAS | 7.0 | 5.0 | 10.0 | 14.0 | 2.0 | — |
| C245AS | 3.0 | 2.0 | 2.0 | 2.0 | 2.5 | 2.5 |
| C45AE3S | 1.0 | 1.0 | 1.0 | — | — | 0.5 |
| C28AS | 2.0 | 1.0 | 2.0 | 1.0 | 0.5 | 3.5 |
| Silicate | 0.2 | — | 1.0 | — | 0.3 | 0.8 |
| Sodium carbonate | 6.5 | 3.0 | 8.0 | 3.0 | 3.0 | 3.0 |
| MBAS | — | 2.0 | — | — | 5.0 | 8.0 |
| SKS-6 | 0.7 | 4.0 | — | 0.5 | 1.0 | 2.0 |
| HEDP/EDDS | 0.3 | 0.2 | — | 0.3 | — | — |
| Zeolite A | 10.0 | 6.0 | 6.0 | 12.0 | 9.0 | 10.0 |
| CMC | 0.5 | — | 0.3 | 0.8 | — | 0.5 |
| Agglomerate | | | | | | |
| TAED | 5.0 | 3.0 | — | 2.0 | 4.0 | 3.0 |
| MA/AA | 1.0 | 0.5 | — | 0.5 | — | 1.0 |
| CMC | — | 0.5 | — | 0.5 | — | — |
| Agglomerate | | | | | | |
| Zeolite A | 2.0 | 1.0 | — | 1.0 | — | 2.0 |
| Sud suppressor | 0.5 | 0.5 | 0.3 | 0.2 | 0.1 | 0.2 |

-continued

| | A | B | C | D | E | F |
|---|---|---|---|---|---|---|
| MA/AA | 0.5 | — | — | 0.2 | — | 0.2 |
| Agglomerate | | | | | | |
| QAS | 1.0 | 0.5 | 1.0 | — | 1.0 | — |
| EFAA | — | — | — | — | 3.0 | — |
| Zeolite | 2.0 | 1.0 | — | — | 2.0 | — |
| Carbonate | 0.5 | 1.0 | — | — | — | — |
| MA/AA | — | 0.1 | — | — | — | — |
| Particle 1 or 2 | — | — | — | 10 | 10.0 | 5.0 |
| Dry add | | | | | | |
| QEA | 1.0 | 0.5 | — | — | 1.0 | — |
| HEDP/DTPA/EDDS | 0.3 | 0.5 | — | 0.5 | 0.5 | 0.5 |
| MA/AA | 1.0 | 2.0 | 3.0 | — | 2.0 | 2.0 |
| Mg sulphate | 0.1 | 0.2 | — | — | — | 0.3 |
| Brightener | 0.1 | — | 0.2 | 0.2 | — | 0.2 |
| Zeolite | 1.0 | 2.0 | 3.0 | 4.0 | 5.0 | 2.0 |
| SKS-6/silicate | 10.0 | 6.0 | 5.0 | 10.0 | 10.0 | 12.0 |
| DOBS/LOBS | — | — | 5.0 | — | — | — |
| Enzymes | 0.5 | 0.8 | 0.3 | 1.2 | 1.2 | 1.0 |
| CMC | 0.2 | — | 0.3 | — | 0.5 | 0.5 |
| Soap | 0.5 | — | — | 0.5 | 1.0 | — |
| NACA OBS | — | 3.0 | — | — | — | 3.0 |
| Photobleach | 0.1 | 0.1 | 0.5 | 0.05 | 0.8 | 0.3 |
| Speckles | 0.5 | 0.2 | 0.7 | — | 0.3 | — |
| Carbonate | 6.0 | 5.0 | 2.0 | — | 8.0 | 7.0 |
| Sodium chloride | 0.2 | — | 0.5 | — | 0.5 | — |
| Sodium sulphate | 2.0 | 3.0 | — | 8.0 | — | 3.0 |
| Percarbonate | 18.0 | 10.0 | 6.0 | 22.0 | 20.0 | 10.0 |
| Citric acid | 1.0 | 0.5 | 2.0 | 3.0 | 2.0 | — |
| Spray on | | | | | | |
| EFAA | — | 2.0 | — | — | 1.0 | — |
| AE5 | — | — | — | — | 0.5 | — |
| Perfume | 0.2 | 0.1 | 0.5 | 0.2 | 0.2 | 0.2 |
| Brightener | 0.1 | 0.2 | 0.1 | 0.1 | 0.1 | 0.1 |

EXAMPLE 2

| | G | H | I | J | K | L |
|---|---|---|---|---|---|---|
| Spray dried powder | | | | | | |
| Base: LAS | 7.0 | 6.0 | 3.0 | — | 4.0 | — |
| MBAS | — | — | — | 5.0 | — | — |
| Tallow alkyl sulphate | 1.0 | — | 1.0 | 1.0 | — | 1.0 |
| C245AS | — | — | 0.5 | — | — | 1.0 |
| Sodium sulphate | 3.0 | 5.0 | 3.0 | 2.0 | — | 3.0 |
| C24AE35 | — | 0.5 | — | 0.5 | — | 0.7 |
| EFAA | 5.0 | 7.0 | — | — | — | — |
| Additives: | | | | | | |
| Sodium carbonate | 3.0 | 6.0 | 1.0 | 3.0 | 5.0 | 3.0 |
| Sodium sulphate | — | 1.0 | 2.0 | 2.0 | — | 5.0 |
| Zeolite A | 16.0 | 10.0 | 5.0 | 10.0 | 6.0 | — |
| MA/AA | 1.0 | — | 1.0 | 0.5 | 1.0 | — |
| Mg sulphate | 0.1 | 0.1 | — | 0.1 | — | 0.1 |
| Brightener | 0.2 | 0.1 | — | — | 0.3 | 0.5 |
| Chelant | 0.5 | 0.5 | — | 0.3 | 0.2 | 0.4 |
| Water | 0.2 | 0.1 | 0.1 | 0.05 | 0.05 | 0.3 |
| Agglomerate | | | | | | |
| EFAA | 5.0 | 7.0 | — | — | — | — |
| LAS | — | 3.0 | 5.0 | 2.0 | — | 5.0 |
| C45AS | — | 2.0 | 3.0 | 2.0 | — | — |
| Carbonate | — | 5.0 | 7.0 | 5.0 | — | — |
| Sulphate | — | 3.0 | — | 2.0 | — | 3.0 |
| Zeolite A | — | 4.0 | 8.0 | 3.0 | — | 9.0 |
| Dry add | | | | | | |
| QEA | 1.0 | 1.0 | 1.0 | — | 1.0 | — |
| Sudsuppressor | 0.5 | 0.5 | 0.5 | 1.0 | 0.2 | 0.3 |

-continued

| | G | H | I | J | K | L |
|---|---|---|---|---|---|---|
| Percarbonate/perborate | 20.0 | 14.0 | 5.0 | 22.0 | 18.0 | 10.0 |
| TAED | 4.0 | 3.0 | — | — | 2.0 | 3.5 |
| NACA OBS | — | 3.0 | — | 4.2 | 2.5 | — |
| NOBS | — | — | 2.0 | — | — | — |
| Zeolite A | 6.0 | 3.0 | 5.0 | — | 7.0 | 12.0 |
| SKS-6/silicate | 8.0 | 12.0 | 5.0 | 9.0 | — | 8.0 |
| Citric acid/citrate | 2.0 | 1.0 | 3.0 | — | — | 2.0 |
| Speckle (carbonate) | 0.3 | 0.5 | 0.4 | — | — | 0.5 |
| Sodium carbonate | 5.0 | — | 8.0 | 10.0 | — | 6.0 |
| Sodium sulphate | 10.0 | 5.0 | — | 3.0 | — | 14.0 |
| CMC | 0.5 | 0.5 | 0.2 | — | — | 0.3 |
| Soap | 0.5 | 0.5 | — | — | 0.5 | — |
| Photobleach 1 | 0.1 | 0.3 | 0.2 | 0.5 | — | — |
| Enzymes | 1.0 | 1.5 | 1.0 | 1.0 | 1.0 | 1.0 |
| SRP | 0.1 | 0.2 | 0.3 | — | 0.3 | — |
| HEDP/EDDS/DTPA | 0.5 | 0.5 | — | 0.2 | 0.8 | 0.3 |
| Spray-on | | | | | | |
| EFAA | — | — | 1.5 | 2.0 | 4.0 | 2.5 |
| Perfume | 0.3 | 0.3 | 0.2 | 0.5 | 0.2 | 0.3 |
| Photobleach 2 | 0.1 | — | — | — | 0.3 | 0.2 |

EXAMPLE 3

The following liquid detergent is in accord with the invention

| | M | N | O | P |
|---|---|---|---|---|
| LAS | 20.3 | 16 | — | — |
| HLAS | — | — | 6 | 6.1 |
| BPP | 18.8 | 19 | — | — |
| Glycerol triacetate | — | — | — | 5.1 |
| C24E5 | 18.8 | — | — | — |
| C11E5 | — | 22 | — | — |
| Vista 10-12 E 6.2 | — | — | 22.4 | 23.3 |
| C25E3 | — | — | 27.3 | 19.3 |
| QEA2 | — | 1.3 | — | — |
| EDDS | — | 1.2 | — | — |
| DTPA | 0.8 | — | — | — |
| MA/AA | 11.6 | 3 | 1.5 | — |
| Carbonate | 11.5 | 7.1 | 16.4 | 17 |
| Calcium carbonate | — | — | 6 | 6.1 |
| Citrate | 4.3 | 4.3 | — | — |
| Citrate coated | 8.5 | — | — | — |
| NOBS/LOBS/DOBS | | | | |
| NAC-OBS | — | 6 | — | — |
| TAED | — | — | — | 5.1 |
| PB1 | 2.9 | 15 | 10.5 | 10.7 |
| Protease prills | 0.8 | 0.8 | 0.7 | — |
| Amylase II | 0.4 | 0.4 | 0.4 | — |
| Cellulase II | — | 0.03 | — | — |
| Brightener 1 | 0.3 | — | — | 0.1 |
| Brightener 2 | — | 0.2 | 0.1 | — |
| Silica | — | — | 4 | 3 |
| Perfume | 0.4 | 1.7 | 0.5 | — |
| CMC | — | — | 1.5 | 1.5 |
| Polymer | | | | — |
| TiO2 | 0.5 | 0.5 | — | — |
| Silicone antifoam | 0.1 | 0.5 | 2.7 | 1.2 |
| Na C16–22 soap | — | 1 | — | — |
| Photobleach 1 or 2 | 0.5 | 0.2 | 0.1 | 0.1 |

EXAMPLE 4

| | Q | R | S | T | U | V |
|---|---|---|---|---|---|---|
| Blown powder | | | | | | |
| LAS | 23.0 | 8.0 | 7.0 | 9.0 | 7.0 | 7.0 |
| TAS | — | — | — | — | 1.0 | — |
| C45AS | 6.0 | 6.0 | 5.0 | 8.0 | — | — |
| C45AE35 | — | 1.0 | 1.0 | 1.0 | — | — |
| C45E35 | — | — | — | — | 2.0 | 4.0 |
| Zeolite A | 10.0 | 18.0 | 14.0 | 12.0 | 10.0 | 14.0 |
| MA/AA | — | 0.5 | — | — | — | 2.0 |
| MA/AA (1) | 7.0 | — | — | — | — | — |
| AA | — | 3.0 | 3.0 | 2.0 | 3.0 | 3.0 |
| Sulfate | 5.0 6.3 | 6.3 | 14.3 | 11.0 | 15.0 | 19.3 |
| Silicate | 10.0 | 1.0 | 1.0 | 1.0 | 1.0 | 1.0 |
| Carbonate | 15.0 | 20.0 | 10.0 | 20.7 | 8.0 | 6.0 |
| PEG 4000 | 0.4 | 1.5 | 1.5 | 1.0 | 1.0 | 1.0 |
| DTPA | — | 0.9 | 0.5 | — | — | 0.5 |
| Brightener 2 | 0.3 | 0.2 | 0.3 | — | 0.1 | 0.3 |
| Spray on | | | | | | |
| C45E7 | — | 2.0 | — | — | 2.0 | 2.0 |
| C25E9 | 3.0 | — | — | — | — | — |
| C23E9 | — | — | 1.5 | 2.0 | — | 2.0 |
| Photobleach | — | — | — | — | — | 0.2 |
| Perfume | 0.3 | 0.3 | 0.3 | 2.0 | 0.3 | 0.3 |
| Agglomerates | | | | | | |
| C45AS | — | 5.0 | 5.0 | 2.0 | — | 5.0 |
| LAS | — | 2.0 | 2.0 | — | — | 2.0 |
| Zelite A | — | 7.5 | 7.5 | 8.0 | — | 7.5 |
| Carbonate | — | 4.0 | 4.0 | 5.0 | — | 4.0 |
| PEG 4000 | — | 0.5 | 0.5 | — | — | 0.5 |
| Misc (water etc) | — | 2.0 | 2.0 | 2.0 | — | 2.0 |
| Dry additives | | | | | | |
| QAS (I) | — | — | — | — | 1.0 | — |
| Citric acid | — | — | — | — | 2.0 | — |
| PB4 | — | — | — | — | 12.0 | 1.0 |
| PB1 | — | 4.0 | 3.0 | — | — | — |
| Percarbonate | 4.0 | — | — | 2.0 | — | 10.0 |
| Carbonate | — | 5.3 | 1.8 | — | 4.0 | 4.0 |
| NOBS | 4.0 | — | 6.0 | — | — | 0.6 |
| TAED | — | 5.0 | — | 2.0 | — | 2.0 |
| Methyl cellulose | 0.2 | — | — | — | — | — |
| SKS-6 | 8.0 | — | — | — | — | — |
| Photobleach 1 | 0.3 | 0.2 | 0.1 | 0.2 | 0.3 | 1.5 |
| STS | — | — | 2.0 | — | 1.0 | — |
| Cumene sulfonic acid | — | 1.0 | — | — | — | 2.0 |
| Lipase | 0.2 | — | 0.2 | — | 0.2 | 0.4 |
| Cellulase | 0.2 | 0.2 | 0.2 | 0.3 | 0.2 | 0.2 |
| Amylase | 0.2 | — | 0.1 | — | 0.2 | — |
| Protease | 0.5 | 0.5 | 0.5 | 0.3 | 0.5 | 0.5 |
| PVPVI | — | — | — | — | 0.5 | 0.1 |
| PVP | — | — | — | — | 0.5 | — |
| PVNO | — | — | 0.5 | 0.3 | — | — |
| QEA | — | — | — | — | 1.0 | — |
| SRP1 | 0.2 | 0.5 | 0.3 | — | 0.2 | — |
| Silicone antifoam | 0.2 | 0.4 | 0.2 | 0.4 | 0.1 | — |
| Mg sulfate | — | — | 0.2 | — | 0.2 | — |
| Silica | 0.2 | 0.2 | 0.2 | — | 0.2 | — |
| Misc/minors to 100% | | | | | | |

EXAMPLE 5

The following detergent formulations, according, to the present invention were prepared:

| | W | X | Y | Z |
|---|---|---|---|---|
| LAS | 18.0 | 14.0 | 24.0 | 20.0 |
| QAS | 0.7 | 1.0 | — | 0.7 |

-continued

| | W | X | Y | Z |
|---|---|---|---|---|
| TFAA | — | 1.0 | — | — |
| C23E56.5 | — | — | 1.0 | — |
| C45E7 | — | 1.0 | — | — |
| C45E35 | 1.0 | 2.5 | 1.0 | — |
| STPP | 32.0 | 18.0 | 30.0 | 22.0 |
| Silicate | 9.0 | 5.0 | 9.0 | 8.0 |
| Carbonate | 11.0 | 7.5 | 10.0 | 5.0 |
| Bicarbonate | — | 7.5 | — | — |
| PB1 | 3.0 | 1.0 | — | 5.0 |
| PB4 | — | 1.0 | 8.0 | — |
| NOBS | 2.0 | 1.0 | 2.0 | 4.0 |
| DTPMP | — | 1.0 | — | — |
| DTPA | 0.5 | — | 0.2 | 0.3 |
| SRP 1 | 0.3 | 0.2 | — | 0.1 |
| MA/AA | 1.0 | 1.5 | 2.0 | 0.5 |
| CMC | 0.8 | 0.4 | 0.4 | 0.2 |
| PEI | — | — | 0.4 | — |
| Sodium sulfate | 20.0 | 10.0 | 20.0 | 30.0 |
| Mg sulfate | 0.2 | — | 0.4 | 0.9 |
| Protease | 0.8 | 1.0 | 0.5 | 0.5 |
| Amylase | 0.5 | 0.4 | — | 0.25 |
| Lipase | 0.2 | — | 0.1 | — |
| Cellulase | 0.15 | — | — | 0.05 |
| Photo bleach 1 or 2 | 30 ppm | 20 ppm | 0.1 | 0.2 |
| Perfume | 0.3 | 0.3 | 0.1 | 0.2 |
| Brightener 1/2 | 0.05 | 0.2 | 0.08 | 0.1 |
| Misc/minors to 100% | | | | |

EXAMPLE 6

The following liquid detergent formulations are in accord with the invention (levels are given in parts per weight):

| | AA | BB | CC | DD | EE | FF | GG | HH |
|---|---|---|---|---|---|---|---|---|
| LAS | 10.0 | 13.0 | 9.0 | — | 25.0 | — | — | — |
| C25AS | 4.0 | 1.0 | 2.0 | 10.0 | — | 13.0 | 18.0 | 15.0 |
| C25E3S | 1.0 | — | — | 3.0 | — | 2.0 | 2.0 | 4.0 |
| C25E7 | 6.0 | 8.0 | 13.0 | 2.5 | — | — | 4.0 | 4.0 |
| TFAA | — | — | — | 4.5 | — | 6.0 | 8.0 | 8.0 |
| APA | — | 1.4 | — | — | 3.0 | 1.0 | 2.0 | — |
| TPKFA | 2.0 | — | 13.0 | 7.0 | — | 15.0 | 11.0 | 11.0 |
| Citric acid | 2.0 | 3.0 | 1.0 | 1.5 | 1.0 | 1.0 | 1.0 | 1.0 |
| Dodecenyl/ tetradecenyl succinic acid | 12.0 | 10.0 | — | — | 15.0 | — | — | — |
| Rape seed fatty acid | 4.0 | 2.0 | 1.0 | — | 1.0 | — | 3.5 | — |
| Ethanol | 4.0 | 4.0 | 7.0 | 2.0 | 7.0 | 2.0 | 3.0 | 2.0 |
| 1,2 Propanediol | 4.0 | 4.0 | 2.0 | 7.0 | 6.0 | 8.0 | 10.0 | 13.0 |
| Mono-ethanolamine | — | — | — | 5.0 | — | — | 9.0 | 9.0 |
| Tri-ethanolamine | — | — | 8.0 | — | — | — | — | — |
| TEPAE | 0.5 | — | 0.5 | 0.2 | — | — | 0.4 | 0.3 |
| NOBS/ NACA-OBS | 3.0 | 1.0 | — | — | 6.0 | 2.0 | 2.0 | 1.0 |
| TAED | — | 1.0 | 4.5 | 2.0 | — | — | 1.0 | — |
| Percarbonate | 6.0 | 8.0 | 18.0 | 16.0 | 21.0 | 10.0 | 15.0 | 4.0 |
| DTPMP | 1.0 | 1.0 | 0.5 | 1.0 | 2.0 | 1.2 | 1.0 | — |
| Protease | 0.5 | 0.5 | 0.4 | 0.25 | — | 0.5 | 0.3 | 0.6 |
| Alcalase | — | — | — | — | 1.5 | — | — | — |
| Lipase | — | 0.10 | — | 0.01 | — | — | 0.15 | 0.15 |
| Amylase | 0.25 | 0.25 | 0.6 | 0.5 | 0.25 | 0.9 | 0.6 | 0.6 |
| Cellulase | — | — | — | 0.05 | — | — | 0.15 | 0.15 |
| Endolase | — | — | — | 0.10 | — | — | 0.07 | — |
| SRP2 | 0.3 | — | 0.3 | 0.1 | — | — | 0.2 | 0.1 |
| Boric acid | 0.1 | 0.2 | 1.0 | 2.0 | 1.0 | 1.5 | 2.5 | 2.5 |
| Calcium chloride | — | 0.02 | — | 0.01 | — | — | — | — |
| Bentonite clay | — | — | — | — | 4.0 | 4.0 | — | — |
| Brightener 1 | — | 0.4 | — | — | 0.1 | 0.2 | 0.3 | — |

-continued

| | AA | BB | CC | DD | EE | FF | GG | HH |
|---|---|---|---|---|---|---|---|---|
| Photobleach 1 or 2 | 0.1 | 0.05 | 0.03 | 0.3 | 0.5 | 1.0 | 0.1 | 0.05 |
| Sud supressor | 0.1 | 0.3 | — | 0.1 | 0.4 | — | — | — |
| Opacifier | 0.5 | 0.4 | — | 0.3 | 0.8 | 0.7 | — | — |
| Water/minors | | | | | | | | |
| NaOH up to pH | 8.0 | 8.0 | 7.6 | 7.7 | 8.0 | 7.5 | 8.0 | 8.2 |

EXAMPLE 7

The following formulations are examples of compositions in accordance with the invention which may be in the form of granules or in the form of a tablet.

| | II | JJ | KK | LL | MM |
|---|---|---|---|---|---|
| C45 AS/TAS | 8.0 | 5.0 | 3.0 | 3.0 | 3.0 |
| LAS | 8.0 | — | 8.0 | — | 7.0 |
| C25AE3S | 0.5 | 2.0 | 1.0 | — | — |
| LAS/NaSKS-6 (I) or (II) Agglomerate at ratio 3:2 | 5.0 | 17.0 | 9.0 | 20.0 | 15.0 |
| C25AE5/AE3 | 2.0 | — | 5.0 | 2.0 | 2.0 |
| QAS | — | — | — | 1.0 | 1.0 |
| Zeolite A | 20.0 | 10.0 | 10.0 | — | 10.0 |
| SKS-6 (I) (dry add) | — | — | 2.0 | — | — |
| MA/AA | 2.0 | 2.0 | 2.0 | — | — |
| AA | — | — | — | — | 4.0 |
| Citrate | — | 2.0 | — | — | — |
| Citric acid | 2.0 | — | 1.5 | 2.0 | — |
| DTPA | 0.2 | — | 1.5 | 2.0 | — |
| EDDS | — | — | 0.5 | 0.1 | — |
| HEDP | — | — | 0.2 | 0.1 | — |
| PB1 | 3.0 | 5.0 | 10.0 | — | 4.0 |
| PC | — | — | — | 18.0 | — |
| NOBS | 3.0 | 4.0 | — | — | 4.0 |
| NACA OBS | — | — | 2.0 | — | — |
| TAED | — | — | 2.0 | 5.0 | — |
| Carbonate | 15.0 | 18.0 | 8.0 | 15.0 | 15.0 |
| Sulphate | 5.0 | 12.0 | 2.0 | 17.0 | 3.0 |
| Photobleach 1 or 2 | 0.1 | 0.05 | 0.2 | 0.8 | 0.1 |
| Silicate | — | 1.0 | — | — | 8.0 |
| Enzyme | 0.3 | 0.3 | 1.0 | 1.0 | 0.2 |
| Minors (Brightener/SRP1/CMC/MgSO4/PVPVI/Suds suppressor/PEG) | 0.5 | 0.5 | 0.5 | 0.5 | 0.5 |
| Perfume | 0.2 | 0.3 | 0.5 | 0.2 | 0.1 |

EXAMPLE 8

The following laundry bar detergent compositions were prepared in accord with the invention (levels are given in parts per weight).

| | NN | OO | PP | QQ | RR | SS | TT | UU |
|---|---|---|---|---|---|---|---|---|
| LAS | — | — | 19.0 | 15.0 | 21.0 | 6.75 | 8.8 | — |
| C28AS | 30.0 | 13.5 | — | — | — | 15.75 | 11.2 | 22.5 |
| Sodium laurate | 2.5 | 9.0 | — | — | — | — | — | |
| Zeolite A | 2.0 | 1.25 | — | — | — | 1.25 | 1.25 | 1.25 |
| Carbonate | 20.0 | 3.0 | 13.0 | 8.0 | 10.0 | 15.0 | 15.0 | 10.0 |
| Calcium carbonate | 27.5 | 39.0 | 35.0 | — | — | 40.0 | — | 40.0 |
| Sulfate | 5.0 | 5.0 | 3.0 | 5.0 | 3.0 | — | — | 5.0 |
| TSPP | 5.0 | — | — | — | — | 5.0 | 2.5 | — |

-continued

| | NN | OO | PP | QQ | RR | SS | TT | UU |
|---|---|---|---|---|---|---|---|---|
| STPP | 5.0 | 15.0 | 10.0 | — | — | 7.0 | 8.0 | 10.0 |
| Bentonite clay | — | 10.0 | — | — | 5.0 | — | — | — |
| DTPMP | — | 0.7 | 0.6 | — | 0.6 | 0.7 | 0.7 | 0.7 |
| CMC | — | 1.0 | 1.0 | 1.0 | 1.0 | — | — | 1.0 |
| Talc | — | — | 10.0 | 15.0 | 10.0 | — | — | — |
| Silicate | — | — | 4.0 | 5.0 | 3.0 | — | — | — |
| PVNO | 0.02 | 0.03 | — | 0.01 | — | 0.02 | — | — |
| MA/AA | 0.4 | 1.0 | — | — | 0.2 | 0.4 | 0.5 | 0.4 |
| SRP1 | 0.3 | 0.3 | 0.3 | 0.3 | 0.3 | 0.3 | 0.3 | 0.3 |
| Protease | — | 0.12 | — | 0.08 | 0.08 | — | — | 0.1 |
| Lipase | — | 0.1 | — | 0.1 | — | — | — | — |
| Amylase | — | — | 0.8 | — | — | — | 0.1 | — |
| Cellulase | — | 0.15 | — | — | 0.15 | 0.1 | — | — |
| PEO | — | 0.2 | — | 0.2 | 0.3 | — | — | 0.3 |
| Perfume | 1.0 | 0.5 | 0.3 | 0.2 | 0.4 | — | — | 0.4 |
| Mg sulfate | — | — | 3.0 | 3.0 | 3.0 | — | — | — |
| Brightener | 0.15 | 0.10 | 0.15 | — | — | — | — | 0.1 |
| Photo bleach 1 or 2 | 0.06 | 0.1 | 0.1 | 0.01 | 0.6 | 0.3 | 0.02 | 0.9 |

What is claimed is:

1. A photo bleaching composition comprising:

A) from 0.5 ppm by weight, of a photo bleaching agent, said agent comprising:

a) a polymeric component, said polymeric component comprising one or more polymeric compounds having an average molecular weight of from 500 to 1,000,000 wherein at least 50% of the monomers which comprise said polymeric compounds comprise one or more di-polar, aprotic groups and have a polymerizable vinyl moiety, the balance comprising monomers selected from the group consisting of acrylic acid, acrylic acid esters, acrylic acid amides, methacrylic acid, methacrylic acid esters, methacrylic acid amides, and mixtures thereof; and b) a photo bleaching component, said photobleaching component comprising a porphyrin having the formula:

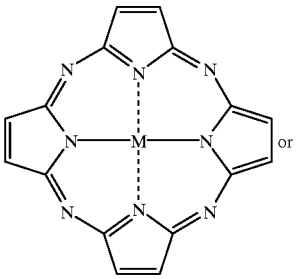

or

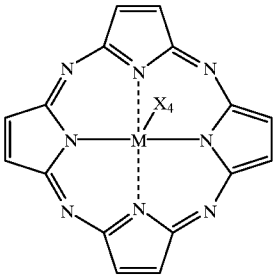

or a phthalocyanine ring having the formula:

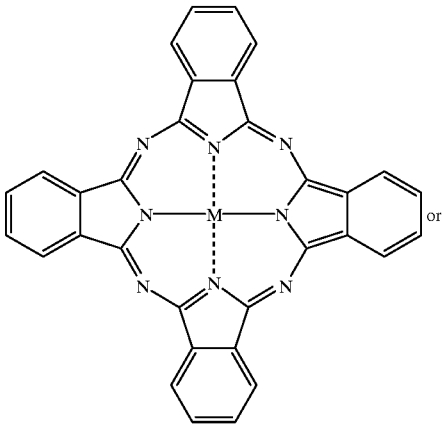

or

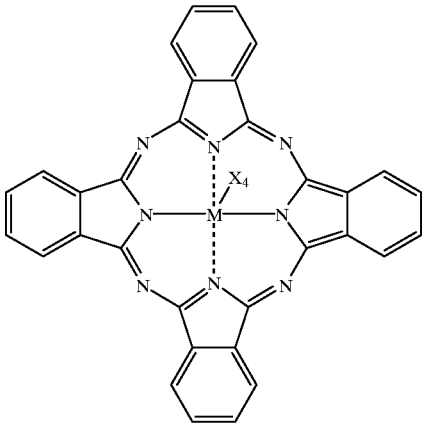

wherein said phthalocyanine ring can optionally be substituted at one or more ring positions, M is a transition metal or cation having an oxidation state of two or greater, $X_4$ is an anion;

wherein said photo bleaching component is integrated with said polymeric component to form said photo bleaching agent and the weight ratio of polymeric component (a) to photobleaching component (b) is from 1:1 to 1000:1;

B) from 0.1% by weight, of a peroxy acid bleaching compound precursor; and

C) the balance carriers and adjunct ingredients.

2. A composition according to claim 1 wherein said polymer component has a molecular weight of from 1,000 to 100,000.

3. A composition according to claim 2 wherein said polymer component has a molecular weight of from 2,000 to 80,000.

4. A composition according to claim 3 wherein said polymer component has a molecular weight of form 5,000 to 60,000.

5. A composition according to claim 1 wherein said dipolar, aprotic group comprising monomers arc selected from the group consisting of N-vinylpyrrolidone, N-vinylacetamide, N-vinylimidazole, N-vinyloxazolidone, N-vinyltriazole, 4-vinylpyridine, 4-vinylpyridine N-oxide, and mixtures thereof.

6. A composition according to claim 1 wherein said polymer component comprises poylvinylimidazole, a copolymer of polyvinylpyrrolidinone and polyvinlyimidazole, and mixtures thereof.

7. A composition according to claim 1 wherein M is selected from the group consisting of calcium, magnesium, phosphorous, titanium chromium, zirconium, indium, tin, hafnium, and mixtures thereof.

8. A composition according to claim 1 wherein $X_4$ is hydroxyl or chloride ion.

9. A composition according to claim 1 wherein said photobleaching component is selected from the group consisting of zinc phthalocyanine, aluminum phthalocyanine chloride, aluminum phthalocyanine hydroxide, and mixtures thereof.

10. A composition according to claim 1 wherein said photo bleaching agent comprises from 90% to 99.9% by weight, of said polymeric component.

11. A composition according to claim 10 wherein said photo bleaching agent comprises from 92% to 99% by weight, of said polymeric component.

12. A composition according to claim 1 wherein said peroxy acid bleaching compound precursor has the formula:

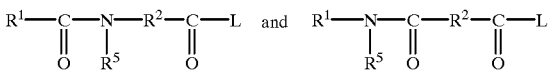

wherein L is a leaving group, $R^1$ is $C_6$–$C_{14}$ aryl, $C_6$–$C_{14}$ alkaryl, and mixtures thereof; $R^2$ is $C_1$–$C_{14}$ alkylene, $C_6$–$C_{14}$ arylene, $C_6$–$C_{14}$ alkarylene, and mixtures thereof, $R^5$ hydrogen, $C_1$–$C_{10}$ alkyl; $C_6$–$C_{10}$ aryl, $C_6$–$C_{10}$ alkaryl, and mixtures thereof; such that the total number of carbon atoms which comprise $R^1$ and $R^5$ does not exceed 18.

13. A composition according to claim 12 wherein said precursor is selected from the group consisting of (6-octanamido-caproyl)oxybenzenesulfonate, (6-decananmidoo-caroyl)oxybenzenesulfonate, (6-nonanamidocaproyl)oxybenzenesulfonate, and mixtures thereof.

14. A composition according to claim 1 wherein said peroxy acid bleaching compound precursor is a N,N,N',N'-tetra acetylated alkylene diamine wherein said alkylene group comprises from 1 to 6 carbon atoms.

15. A composition according to claim 1 further comprising a source of hydrogen peroxide selected from the group consisting of a percarbonate salt, a perborate salt, and mixtures thereof.

16. A photo bleaching composition comprising:

A) from 0.5 ppm by weight, of a photo bleaching agent, said agent comprising:

a) a polymeric component, said polymeric component comprising one or more polymeric compounds having an average molecular weight of from 500 to 1,000,000 wherein at least 50% of the monomers which comprise said polymeric compounds comprise one or more di-polar, aprotic groups and have a polymerizable vinyl moiety, the balance comprising monomers selected from the group consisting of acrylic acid, acrylic acid esters, acrylic acid amides, methacrylic acid, methacrylic acid esters, methacrylic acid amides, and mixtures thereof; and b) an insoluble in water or slightly soluble photo bleaching component, said photobleaching component selected from one or mores zinc phthalocyanines, aluminum phthalocyanines, and mixtures thereof;

wherein said photo bleaching component is integrated with said polymeric component to form said photo bleaching agent and the weight ratio of polymeric component (a) to photobleaching component (b) is from 1:1 to 1000:1;

B) from 0.1% by weight, of a peroxy acid bleaching compound precursor; and

C) the balance carriers and adjunct ingredients.

17. A composition according to claim 16 wherein said precursor is selected from the group consisting of (6-octanamido-caproyl)oxybenzenesulfonate, (6-decananmidoo-caroyl)oxybenzenesulfonate, (6-nonanamidocaproyl)oxybenzenesulfonate, and mixtures thereof.

18. A composition according to claim 16 wherein said peroxy acid bleaching compound precursor is a N,N,N',N'-tetra acetylated alkylene diamine wherein said alkylene group comprises from 1 to 6 carbon atoms.

19. A composition according to claim 16 further comprising a source of hydrogen peroxide selected from the group consisting of a percarbonate salt, a perborate salt, and mixtures thereof.

* * * * *